United States Patent [19]

Tamai et al.

[11] 3,968,044

[45] July 6, 1976

[54] MILLED LIQUID DEVELOPER

[75] Inventors: Yasuo Tamai; Hajime Miyatuka, both of Tokyo, Japan

[73] Assignee: Rank Xerox Ltd., London, England

[22] Filed: Feb. 1, 1974

[21] Appl. No.: 438,896

[52] U.S. Cl. ..... 252/62.1 L; 96/1 LY; 427/15; 427/17; 106/309

[51] Int. Cl.[2] ..... G03G 9/03

[58] Field of Search ..... 252/62.1; 96/1 LY; 117/37 LE; 427/15, 17; 106/309

[56] References Cited

UNITED STATES PATENTS

| | | | |
|---|---|---|---|
| 3,503,881 | 3/1970 | Shinohara et al. | 117/37 LE X |
| 3,551,337 | 12/1970 | Robinson | 252/62.1 |
| 3,554,946 | 1/1971 | Okuno et al. | 252/62.1 |
| 3,585,140 | 6/1971 | Machida et al. | 252/62.1 |
| 3,623,986 | 11/1971 | Machida et al. | 252/62.1 |
| 3,629,117 | 12/1971 | Okuno | 252/62.1 |
| 3,639,243 | 2/1972 | Okuno et al. | 252/62.1 |
| 3,639,244 | 2/1972 | Machida et al. | 252/62.1 |
| 3,669,886 | 6/1972 | Kosel | 252/62.1 |
| 3,714,048 | 1/1973 | Adachi et al. | 252/62.1 |
| 3,729,418 | 4/1973 | Machida et al. | 117/37 LE X |

*Primary Examiner*—Roland E. Martin, Jr.

[57] ABSTRACT

A liquid developer composition is given whereby a dispersion comprising a milled mixture of graft pigment and alkyd resin is dispersed in an insulating liquid.

7 Claims, No Drawings

MILLED LIQUID DEVELOPER

This invention relates to imaging systems, and more particularly, to improved developer materials.

The formation and development of images on the surface of photoconductive materials by electrostatic means is well known. The basic electrostatographic process, as taught by Carlson in U.S. Pat. No. 2,297,691 involves placing a uniform electrostatic charge on a photoconductive insulating layer, exposing the layer to a light and shadow image to dissipate the charge on the areas of the layer exposed to the light and developing the remaining electrostatic latent image by depositing on the image a finely divided electroscopic marking material sometimes called "toner". Toner will normally be attracted to those areas of the layer which retain a charge, thereby forming a toner image corresponding to the electrostatic latent image. This powder image may then be transferred to a support surface such as paper. Such a transferred image may subsequently be permanently affixed. It is well known that a latent image may be formed on an appropriate surface by direct charging in image configuration. Likewise, one may develop and fix an image to the latent image holding substrate.

Development of an electrostatic latent image may also be achieved with liquid rather than dry developer materials. In liquid development commonly referred to as electrophoretic development an insulating liquid vehicle having finely divided solid marking material dispersed therein contacts the imaging surface in both charged and uncharged areas. Under the influence of the electric field associated with the charged image pattern, these suspended particles migrate toward the charged portions of the imaging surface separating out of the insulating liquid. This migration of charged particles results in the deposition of the marking particles on the imaging surface in image configuration. Electrophoretic development of an electrostatic latent image may, for example, be obtained by flowing the liquid developer over the image bearing surface, by immersing the imaging surface in a pool of the developer or by presenting the liquid developer on a smooth surfaced roller and moving the roller against the imaging surface. Other development techniques are known.

Another technique for developing latent images by liquid development is known as out-of-contact development. In this method, an electrostatic latent image is developed or made visible by presenting to the imaging surface a liquid developer on the surface of a developer dispensing member having a plurality of raised portions or "lands" defining a substantially regular patterned surface and a plurality of portions depressed below the raised portions or valleys. The depressed portions of the developer dispensing member contain a layer of liquid developer which is maintaned out of contact with the electrostatographic imaging surface. Development is achieved by moving the developer dispensing member loaded with liquid developer in the depressed portions into developing configuration with the imaging surface. The liquid developer is believed to be attracted from the depressed portions of the applicator surface in the charged or image areas only. It is also possible to employ a smooth developer dispensing member holding on its surface liquid developer at a predetermined spaced from the image bearing surface. Development is achieved by developer transferring over to the image bearing surface by attraction.

This invention relates to liquid developer adapted for use in liquid developing processes wherein toner particles having an electrostatic charge of a same sign are dispersed homogeneously in a carrier liquid.

Liquid developer generally consists of a colloidal dispersion in which fine particles of submicron size comprising pigment and/or resin and provided with electrostatic charge of a same sign are dispersed in a liquid as dispersion medium which is the carrier liquid.

Liquid developer may be prepared by milling toner and resin soluble in carrier liquid for a long period to obtain homogeneous dispersion and then dispersing thus prepared mixture into a carrier liquid. The liquid developer of this type is called milling type liquid developer.

On the other hand, another type of liquid developer showing relatively high dispersibility can be prepared without the milling steps by dispersing graft pigment, in which resin component is chemically bonded directly on the particle surface of toner pigment, into carrier liquid. The liquid developers of this type are called graft type liquid developer.

Graft pigment is sometimes obtained by reacting addition-polymerizable monomer, pigment and a small amount of polymerization initiator in a solvent such as benzene to graft-polymerize said monomer on the surface of the pigment. Liquid developer can then be prepared by dispersing the graft pigment into carrier liquid. Said addition-polymerizable monomer can be for example, higher saturated alkyl acrylates as disclosed in Japanese Patent Publication 19196/96, higher saturated alkyl acrylate-branched saturated alkyl acrylate copolymers as disclosed in Japanese Patent Publiction 6151/69. Also known as useful monomers are lauryl methacrylate-diethylaminoethyl methacrylate copolymer, lauryl methacrylate-acrylic acid copolymer, lauryl methacrylate-acrylonitrile copolymer, styrene-lauryl methacrylate-acrylic acid copolymer, lauryl methacrylate-potassium methacrylate copolymer and many others.

Graft type liquid developers are characterized by the excellent dispersion stability of toner particles; this is presumably due to the fact that the polymer chains bonded to the surface of pigment are saturated alkyls and, therefore, prevent gelation or hardening because of the low reactivity between polymer chains. Graft type liquid developer, even after formation of sedimentation on the bottom after prolonged storage, can be restored to stable and homogeneous dispersion simply by ordinary agitation. The graft type liquid developer has high electric resistance and therefore easily provides high developing density when developing electrostatic latent images. Consequently the surface potential of the electrostatic latent image can be relatively low, and in case of electrophotographic process, for example, considerably high developing density can be obtained even if the potential given to the photosensitive material is low. This allows for a wider selection of photosensitive materials.

In order to make use of this advantage, however, it becomes often necessary to subject said graft pigment to certain pre-treatments. More specifically the graft pigment is preferably added into carrier after being treated with polar solvents such as butanol or ethanol which are capable of dissolving polymers of low molecular weight, thereby removing the materials present in said graft pigment and soluble in said polar solvent.

For all of these benefits, graft type liquid developers have certain disadvantages. Though liquid developers of this type do not require special milling, the image obtainable with such developers often lacks the details comparable to those obtained with developers manufactured by milling techniques. Besides, in graft type developer, the addition of charge controlling agents often become necessary because of instability in the charge polarity of the toner particles. Said addition stabilizes the polarity of electrostatic charge on the toner particles and enables one accordingly to elevate the density of developed image.

However the durability of the effect of such addition is sometimes unreliable; the characteristics of the developer often go back to their original state before the addition was made. Such behavior is presumably explained by the fact that such additions of charge controlling agents cannot exhibit sufficient stabilizing effects by the adsorption onto the surface of pigment alone since the active adsorption sites on the surface of the pigment particles are already occupied by the polymer chains. Moreover, most charge controlling agents cannot be added beyond a certain limit since the continued addition thereof generally lowers the electric resistance of liquid developer.

Furthermore, the graft type developer has the tendency of developing minute electrostatic charges simultaneously with their ability of elevating the developed density. The use of these developers results in images having elevated fog levels particularly where the developing processes utilizing an electrode located closely to the developing system.

Another drawback is that liquid developers of this type frequently gives images having uneven density. This defect is particularly noticeable when images of wide area are developed to a relatively low density.

Furthermore, graft type developers have a strong tendency to adhere to various materials. Therefore, they form smudge and stain marks easily on storage containers, recording materials, developing devices, and other inconvenient places resulting in difficulty in maintenance.

Additionally there is a problem of streaks on the developed image. Although various additives are known to be effective in reducing this tendency, as in the case of charge controlling agents, such additives lower the electric resistance of the developer resulting in low image density.

It is an object of this invention to provide for an improved liquid developer. It is a further object to provide for a liquid developer which does not substantially stain, develops uniform images, has high density, low levels of fogging, provides stable charge polarity, and does not streak. Other objects and advantages will become apparent from a full understanding and reading of the ensuing specification and examples.

It has been surprisingly found that a unique liquid developer can be made by blending graft pigment and alkyd resin for a sufficiently long time to obtain a dispersion, and then dispersing the thus obtained dispersion into a carrier liquid vehicle which is capable of dissolving the alkyd resin.

The unique process of this invention is an improvement combining both the advantages of a milling type liquid developer process with graft developer process with an additional and unobviously useful step. Graft pigments can be easily dispersed without the use of strong mechanical forces which contrasts with the work required to disperse ordinary powdered pigments.

With regard to the graft pigment, a wide range of materials and products can be utilized in the process of this invention. Included are materials such as graft pigments obtainable by the graft-copolymerization of higher saturated alkyl acrylate, such as, for example, lauryl acrylate on carbon black, those obtainable by graft-copolymerization of lauryl methacrylate-hydroxyethyl methacrylate copolymer or styrene-lauryl methacrylate-hydroxyethyl methacrylate copolymer on carbon black or spirit black, those obtainable by graft-copolymerization of lauryl methacrylate-hydroxyethyl methacrylate-acrylic acid copolymer on spirit black or alkali blue, those obtainable by graft-copolymerization of styrene-lauryl methacrylate copolymer on aniline black or carbon black, those obtainable by graft-copolymerization of octyl methacrylate-acrylonitrile-glycidyl methacrylate copolymer on aniline black, those obtainable by graft-copolymerization of potassium methacrylate-dodecyl methacrylate-N,N-dimethylaminomethyl acrylate copolymer on aniline black or those obtainable by graft-copolymerization of decyl methacrylate-N,N-dimethylaminoethyl methacrylate-glycidyl methacrylate copolymer on phthalocyanine blue.

The polymers bonded to the surface of the graft pigment have no critical characteristics insofar as is known, and thus they may be selected from any group or class. Those disclosed in Japanese Publication No. 19196/69, which is herein incorporated by reference, are quite satisfactory and desirable within the scope of this invention.

The graft pigment to be employed in this invention may optionally be treated with organic solvent of considerably strong polarity such as acetone, methanol, ethanol, butanol, and so on, in order to remove polymers of lower molecular weight soluble therein and polar impurities which eventually lower the electric resistance of the liquid developer. Otherwise such treatment with solvent can naturally be carried out after the milling with alkyd resin if it is desired.

It is preferred that the alkyd resin employed in this invention be easily soluble in the carrier liquid selected which is usually a highly insulating liquid having a resistance of greater than about $10^7$ ohm-cm. Such liquids generally have relatively low dissolving power. Decalin, cyclohexane, kerosene and isoparaffinic hydrocarbons among others are considered satisfactory.

Among the alkyd resins which can be suggested are alkyd resins denatured with vegetable oil, such as, for example, linseed oil, soybean oil, safflower oil, castor oil, and others. Any oil length is believed satisfactory, but it is preferred to use medium or long oil lengths including those of greater than 50 percent.

Alkyd resins denatured with rosin or phenol are also employable.

The milling treatment may be accomplished in any manner, for example, in sand mill, roll mill, attriter, etc., and preferably in ball mill. The treating time should be until the dispersion is complete. Generally from 2 to 50 hours is satisfactory.

Alkyd resins shown certain changes in the properties thereof by the milling treatment. In general, mechanical force applied by the dispersing machine tends to lower the molecular weight due to the breaking of resin molecules. Prolonged treatment promotes the hardening reaction which results in a partial gelation of the resin and eventually in the insolubilization of the resin. Although such change seldom proceeds to actual insolubilization of resin within the duration of milling treatment, enough occurs for realizing the objects of this invention. The amount and milling time of this alkyd resin should be regulated since lowered molecular weight will lower the electric resistance of the developer, and may prevent the increased developing density.

The amount of alkyd resin may vary to a certain extent depending upon the blending period and the desirable toner concentration in the liquid developer.

An addition of excessively large amount will result in developer incapable of providing images of high developing density. On the other hand, an addition of an excessively low amount will be incapable of effectively realizing the objects of this invention.

For example, in the case of preparing liquid developer of toner concentration corresponding to 1 gram of graft pigment in 1 liter of developer, the amount of alkyd resin to be added should be in a range of 0.1 – 100 g, preferably of 0.7 – 30 g. An amount of addition less than 0.1 g will be incapable of providing liquid developer satisfying the objects of this invention even if the milling treatment is prolonged. On the other hand, an amount of addition exceeding 100 g will generally result in unsatisfactory liquid developer with lowered electric resistance and elevated viscosity.

Besides, an excess milling treatment will also give rise to the drawbacks explained above and will not give satisfactory liquid developer even if the amount of addition lies in the preferred range stated above. In case of using ball mill for blending under the conditions mentioned above, the milling time should be kept within 150 hours, preferably between 20 and 50 hours. Naturally, the optimum milling time varies to some extent according to the milling conditions such as the material of the ball mill, revolution thereof, number of balls, amount of charging, etc.

Thus, the amount of alkyd resin is dependent also on the milling treatment and the amount of resin to be denatured, and therefore should be defined with respect to the total amount of liquid developer as well as to the amount of graft pigment. More precisely the lower limit of said amount is determined in relation with the graft pigment while the upper limit thereof is to be defined in connection with said total amount of developer. Thus, as explained above, the lower and upper limits of the amount of addition of alkyd resin are defined as 0.1 g per 1 g of graft pigment and 100 g per 1 liter of liquid developer, respectively, and the preferably range of said amount is between 0.7 g per 1 g of graft pigment and 30 g per 1 liter of liquid developer.

In general alkyd resin shows an effect of giving positive charge to toner particles of the liquid developer. Also in this invention, the graft pigment becomes charged positively because of the same effect. This effect, however, becomes unclear if the amount of alkyd resin is very little with respect to that of graft pigment. Also for this reason, therefore, alkyd resin should be added at least in the amount of lower limit defined above.

It is experimentally confirmed that the objects of this invention are gradually realized as the milling time is prolonged or as the degree of dispersion proceeds.

A liquid developer provided with positive charge polarity can also be prepared simply by adding alkyd resin into a dispersion of graft pigment alone.

Such developer is inevitably associated, however, with the drawbacks of graft type developer such as streaks, tendency to cause uneven developing, high fog level, etc.

The milling of alkyd resin and graft pigment can only lead to the decrease of smudge, streaks, uneven density and fog level to realize the objects of this invention.

The advantage of this invention lies in the fact that the use of charge regulating agents is made unnecessary despite of the presence of graft pigment. Namely, the combined use thereof with alkyd resin renders it possible to endow positive charge polarity to toner particles in the developer. In many cases, graft pigment alone does not show very discrete charge polarity, but milling treatment with alkyd resin according to the process of this invention provides a definite charge polarity which is stable for long period.

Streaks and fog level are markedly decreased without significant lowering of density of developed image as the milling period of alkyd resin and graft pigment is made longer. Such lowering of streaks and fog level is also observable in the milling developer utilizing alkyd resin when the milling time is prolonged.

Consequently, the advantages of this invention can be considered to be derived from the simultaneous milling operation of alkyd resin and graft pigment.

The advantage of the liquid developer prepared according to the process of this invention principally lies in the easiness of obtaining developed image of high density.

Another advantage of said developer lies in the extremely high stability of dispersion enabling prolonged storage. Of course the developer may eventually precipitate toner particles on the bottom of the container, but it can be easily restored to complete dispersion simply by mild shaking.

The characteristics of the liquid developer according to the process of this invention, such as easiness of obtaining high density in developed image or extremely high time-dependent stability of dispersion, are presumed to be derived from the properties of graft pigment as treated in this invention.

The liquid developer according to this invention may show some gelation after prolonged storage because of presence of alkyd resin, but is far stabler than milling type utilizing alkyd resins and can be improved further as to this point by the use of suitable antioxidizing agents.

Alkyd resin has many and various advantages as the component of the liquid developer.

In the first place, alkyd resins show extremely high affinity for pigments, and are therefore capable of dispersing the pigment into very fine particles. This fact makes the use of this material particularly satisfactory.

Besides, the developer therefrom shows less streaks and less fog level as the degree of dispersion increases.

Furthermore, the use of liquid developer according to the process of this invention enables it to prevent unevenness in the developed density, to prevent stain in the non-image area of recording sheet such as paper or plastic film, and to prevent stain on the developing machine, etc.

The above-mentioned advantages derived from the use of graft pigment cannot be found in the conventional graft type developers and are only made possible according to the process of this invention.

Thus, the liquid developer according to the process of this invention is capable of developing an electrostatic latent image into a visible image of high image quality and high image density without showing elevated fog level, streaks, unevenness in density and strain.

Consequently, the developer according to the process of this invention is particularly effective in the case of reproducing an image of continuous tone by means of an eletrophotographic process.

The process according to this invention is to provide a novel liquid developer provided with the advantages of the conventional graft type liquid developers and at the same time free from the disadvantages thereof, by means of milling graft pigment together with alkyd resin.

The liquid developer according to the process of this invention is provided further with another advantage of the improved strength of toner image obtained therewith. Although the toner image obtained by conventional graft developers is apt to be damaged or peeled off by mechanical friction etc., the developer of this invention results in relatively strong toner images. This fact is presumably attributable to the use of alkyd resin, and the toner image becomes stronger after a prolonged period by means of auto-oxidation, and other long term effects.

This invention will be further clarified by the following non-limiting examples. All parts and percentages are by weight unless otherwise started.

EXAMPLE I

The following three liquid developers were prepared for comparative evaluation. Developer A was prepared according to this invention. Developers B and C were prepared in accordance with well known prior techniques for comparative purposes.

Developer A (The Invention)

One hundred parts by weight of graft carbon SLC-512 (a standard material available from Japan Gas Chemical Industries Co., Ltd.; pretreated with ethanol contaning methacrylic resin), one hundred fifty parts by weight of alkyd resin Super Beckosol J537 (Japan Reichhold Co., Ltd.; denatured with safflower oil having an oil length of 65 percent), and one thousand parts of isoparaffinic hydrocarbon as dispersing agent (Isopar H available from Esso Standard Oil Company) were milled for about 30 hours in a ball mill. The dispersion thus obtained was further dispersed in Isopar H so that the liquid developer obtained had the concentration of 1 gram of graft carbon per liter.

Developer B (Graft-type Developer)

Graft carbon SLC-512 as employed in Developer A above, was dispersed in Isopar H by means of ultrasonic wave dispersion employing sufficient graft carbon to achieve a liquid developer having a final concentration of 1 gram of graft carbon per liter. It was noted that the developer obtained contained toner particles which did not demonstrate discrete charge polarity, but rather were amphoteric in behavior. A small amount of cobalt naphthenate was added to render the particles positive so that the developer could be tested.

Developer C (Milling-type Developer)

Fifty parts by weight carbon black Nippil No. 100 (Nittetsu Chemical Industries; channel process carbon black), three hundred parts of the alkyd resin of Developer A, and 600 parts of Isopar H were milled in a ball mill for 30 hours. The dispersion thus obtained was further dispersed in Isopar H so that the liquid developer had a final concentration of 1 gram of carbon black per liter.

Each of the liquid developers was employed for developing a number of electrostatographic latent images on an image bearing surface. Various measurements and observations were noted.

For Developer A, the developer produced by this invention, the electrical resistance was $1.2 \times 10^{12}$ ohm-cm, developing density was 2.0, fog density was 0.13, and it showed almost no streaks. While the developer of this invention produced visible images of excellent quality, high density, and substantially free of fog, it was additionally found not to form stain on the equipment and non-image areas of the photosensitive material.

Developer B, produced by the well known graft technique, had an electrical resistance of $8.0 \times 10^{12}$ ohm-cm, developing density of 2.4, fog density of 0.32, and showed marked streaking. It stained the equipment.

Developer C, produced by the well known milling technique had electrical resistance of $4.0 \times 10^{12}$ ohm-cm, developing density of 1.6, fog density of 0.11, and showed a slight tendency to streak. Developer C stained the equipment and the non-image areas of the photosensitive material.

EXAMPLE II

A mixture of 0.95 moles of lauryl methacrylate and 0.05 moles of acrylic acid was reacted with carbon black (25 percent by total weight of said mixture), azobis-isobutyronitrile (polymerization initiator; 0.7 – 0.8 percent of said weight), and toluene (nearly equal to said total weight) for 10 hours at 70°C. to obtain a dispersion containing the graft carbon.

One hundred parts by weight of said graft carbon, 100 parts by weight alkyd resin (Beckosol J555 - Japan Reichhold; denatured with castor oil having an oil length of 52 percent), and 400 parts by weight kerosens were milled in a ball mill for 40 hours, and the resulting dispersion was then dispersed into additional kerosens so as to obtain a final toner concentration of 30 grams per liter of developer.

Upon testing, this developer gave results similar to those of Developer A of Example I.

EXAMPLE III

The process and composition of Example I, Developer A were repeated using 5 hours of milling in an attriter instead of the ball mill. The liquid developer produced had considerably good quality and gave similar results to those of Example I, Developer A.

EXAMPLE IV

The process of Example I, Developer A was reproduced except for employing alkyd resin denatured with rosin (Beckosol P450; Japan Reichhold; denatured with linseed oil and fish oil; oil length 50 percent) and employing kerosens as the dispersion solvent and carrier liquid.

On testing it was found that this process provided a liquid developer of excellent characteristics.

EXAMPLE V

The process of Example IV was reproduced under the same conditions except that the alkyd resin was replaced by phenol-denatured alkyd resin (Phthalkyd P522-50; Hitachi Kasei; denatured with nut oil and linseed oil; oil length 52 percent) to obtain a liquid developer of good characteristics which satisfied the objects of this invention.

EXAMPLE VI

Graft pigment was prepared as follows: a mixture of 0.6 moles of aluryl methacrylate and 0.4 moles of acrylic alcohol was reacted with 0.005 moles of azobis-isobutyronitrile as the polymerization initiator and 1 mole of toluene for 9 hours at 90°C. in nitrogen a stream to obtain a copolymer. Seven parts by weight of said copolymer and 1 part by weight of spirit black were blended with 40 parts by weight of Isopar H iso-paraffinic hydrocarbon in a ball mill for about 10 hours to obtain homogeneous dispersion, which was further treated with ethanol to obtain solid product.

The following composition was milled in a ball mill for about 30 hours to obtain a dispersion:

| | |
|---|---|
| Graft pigment containing spirit black | 100 parts by weight |
| Alkyd resin Super Beckosol EL8011 (Japan Reichhold; denatured with linseed oil; oil length 80 percent) | 180 parts by weight |
| Dispersion solvent Kerosene | 900 parts by weight. |

The dispersion was further dispersed into Isopar H so that the final composition of the developer contained 10 grams of graft carbon per liter.

Upon testing, developed images were formed having good resolution, high density, low fogging, and additionally the developer was found not to stain the equipment.

It will be appreciated by those skilled in the art that many modifictions of the disclosed steps and techniques can be made without deviation from the spirit and scope of the invention, and such modifications are intended to be within the scope of the appended claims.

What is claimed is:

1. A liquid developer for forming visible images on the surface of a latent image bearing member comprising a milled dispersion of about one gram graft pigment and from about 0.1 to about 100 grams alkyd resin which is soluble in the developer carrier, said dispersion being homogeneously dispersed in about one liter of an electrically insulating carrier liquid.

2. The liquid developer of claim 1 wherein said dispersed mixture of graft pigment and alkyd resin is milled for from about 2 hours to about 50 hours prior to being dispersed into the carrier liquid.

3. The liquid developer of claim 1 wherein the alkyd resin is present in an amount of from about 0.1 gram per 1 gram of graft pigment to about 100 grams per liter of liquid developer.

4. A process for preparing a liquid developer for forming visible images on an electrostatic latent image bearing surface comprising milling for less than about 150 hours about one gram graft pigment and from about 0.1 to about 100 grams alkyd resin which is soluble in the developer carrier liquid together to form a well mixed dispersion, and dispersing this mixture in about one liter of developer carrier liquid.

5. The process according to claim 1 wherein the graft pigment and alkyd resin are blended together for from about 2 to about 50 hours.

6. The process according to claim 1 wherein the graft pigment comprises graft carbon.

7. The process according to claim 1 wherein the alkyd resin has an oil length of at least 50 percent.

* * * * *